United States Patent [19]

Seragnoli

[11] 3,956,110

[45] May 11, 1976

[54] DEVICE FOR CHECKING THAT THE UNDERNEATH PART OR BASE, PARTICULARLY OF PACKETS OF CIGARETTES AND SIMILAR, HAS BEEN PROPERLY SEALED DOWN

[75] Inventor: Enzo Seragnoli, Bologna, Italy

[73] Assignee: G. D. Societa per Anzioni, Bologna, Italy

[22] Filed: May 29, 1974

[21] Appl. No.: 474,440

[30] Foreign Application Priority Data

July 11, 1973 Italy ..... 3450/73

[52] U.S. Cl. ..... 209/82; 53/53; 209/90

[51] Int. Cl.[2] ..... B07C 1/10

[58] Field of Search ..... 209/73, 74, 88, 90, 209/82, 80; 53/378, 53

[56] References Cited

UNITED STATES PATENTS 2,400,682 5/1946 Bronander ..... 53/378

FOREIGN PATENTS OR APPLICATIONS 914,666 1/1963 United Kingdom ..... 209/90

*Primary Examiner*—Robert B. Reeves
*Assistant Examiner*—H. Grant Skaggs
*Attorney, Agent, or Firm*—Browdy and Neimark

[57] ABSTRACT

A device for checking that the base of packets of cigarettes or the like, has been properly sealed down in production lines of the type comprising at least one wrapping machine, at least one overwrapping machine, a conveyor for conveying packets from the wrapping to the overwrapping machine, a memory or retard line for storing signals, working in conjunction with an injection replenishment station for ejecting faulty packets from the production line and for replenishing said production line with products kept in reserve. The checking device is positioned along the conveyor and comprises structure for rendering a faulty base on a wrapped product conspicuous, feeler means for detecting the fault that has been made conspicuous, and structure for restoring the faulty base back in the condition it was originally in prior to being made conspicuous. The feeler sends a signal to the memory system which activates the ejection/replenishment station when the faulty packet reaches such station.

6 Claims, 4 Drawing Figures

DEVICE FOR CHECKING THAT THE UNDERNEATH PART OR BASE, PARTICULARLY OF PACKETS OF CIGARETTES AND SIMILAR, HAS BEEN PROPERLY SEALED DOWN

BACKGROUND OF THE INVENTION

The present invention relates in general to plants used to wrap and pack products, particularly machines for packeting batches of cigarettes, and has as its subject a device for checking that the base of said packets has been properly sealed down.

DESCRIPTION OF THE PRIOR ART

It is known in these types of plants that the wrapped products coming from a wrapping machine are that routed along an exiting channel wherein several checking operations are carried out on the wrapped products, such as, for example, a check to verify that none of the items which go to make up a packet are missing. These items, for the soft or "American" type of packet, are known to consist of a first or inner wrap of lined foil, a second or outer wrap of paper, commonly known as the "label" and a sealing label or revenue stamp on the mouth of the packet.

Subsequently to the aforementioned checking operations and, for example, by means of a rotatable wheel located below the exiting channel, as described in U.S. Pat. No. 3,899,863, faulty packets are ejected, whilst those which are perfect are sent forward towards overwrapping machines, the task of which is to enshroud them in an additional wrap, for example, transparent thermoplastic material in cases when machines commonly known as "cellophaners" are used.

The transforming of the wrapped products generally takes place along a line which not infrequently has to change direction either to suit the layout of the machines in the factory premises where they are installed or because of the need to modify the direction in which the products have to be when exiting from the overwrapping machine.

In actual practice, with a transfer along conveyor belts which often extend a considerable distance and because of friction caused by the high transfer speeds required to suit wrapping machines which are constantly becoming ever more perfect, as well as the impact each time the conveyor belt undergoes a change of direction and the compression (stress) when non-return systems (such as those described in commonly owned U.S. Ser. No. 432,587, filed January 10, 1974) are used it often happens that the packet of cigarettes is subjected to a protracted period of stress which may cause unsealing of the base of said packet.

This is due to the fact that, compared with the other parts of the packet, the base is more rigid because of the particular way in which the label is folded. Thus its propensity to flexibly absorb the stress applied thereto is less than that of the other parts of the packet.

As a consequence of the foregoing, it can happen that the two panels previously glued and overlapped on the wrapping machine may become unsealed.

For the reasons stated above, after each transfer operation, but prior to the entry point to the overwrapping or cellophaning machine, it is necessary that a further checking operation be performed in order to verify that the base of each packet is properly sealed down in order to ensure compliance with the hermetic and impermeable requirements for the products in question.

Once the presence of a faulty packet has been detected, the problem then arises of ejecting it and this is something which, if possible, must be done without adversely affecting the normal operation, at its rated speed, of the overwrapping machine.

SUMMARY OF THE INVENTION

The present invention proposes to solve the above mentioned problems by making available a device which is able to detect and signal the presence of packets whose base is open and, subsequently, to cause them to be ejected, in a way in which none of the said operations have any adverse effect whatsoever on the normal operation of the overwrapping machine.

A device of this nature has, in fact, to be designed to work in conjunction with the memory system or retard line of the overwrapping machine, to which other checking devices pertinent to the operations performed by the said overwrapping machine are connected and to also use the same station for ejecting faulty packets from the production line, as well as the relevant device coupled thereto for replacing rejected products with others kept in reserve in order to replenish or complete the line in accordance with the terms of U.S. Pat. No. 3,318,066.

In order that this can be achieved, the device according to the invention causes the fault on an imperfect product to be made conspicuous, detected and subsequently put back in its former condition in such a way that the faulty packet can be kept in the production line, just as though no imperfection existed and then be expelled at the ejection/replenishment station on the production line of the overwrapping machine, as a consequence of the previously effected check.

The subject of the present invention is, therefore, a device for checking that the base, particularly of packets of cigarettes or the like, has been properly sealed down in production lines of the type comprising at least one wrapping machine and at least one overwrapping machine, and conveyor means for conveying packet, from the wrapping machine to the overwrapping machine, a memory system or retard line for storing signals and an ejection/replenishment station for ejecting faulty packets from the production line and for replenishing the production line with other products kept in reserve. The checking device is positioned along the conveyor means, and comprising for rendering a faulty base on a wrapped product conspicuous, feeler means for detecting the fault that has been made conspicuous, and means for restoring the faulty base back in the condition in which it was prior to being made conspicuous. The feeler means works in conjunction with the aforementioned memory system or retard line in such a way as to cause the said ejection/replenishment device to operate.

BRIEF DESCRIPTION OF THE DRAWINGS

Further characteristics and advantages will emerge more clearly from the following detailed description of a preferred but not the sole form of embodiment for the device according to the invention, illustrated purely as an unlimited example on the accompanying drawings in which.

DESCRIPTION OF THE PREFERRED EMBODIMENT

Figure 1:
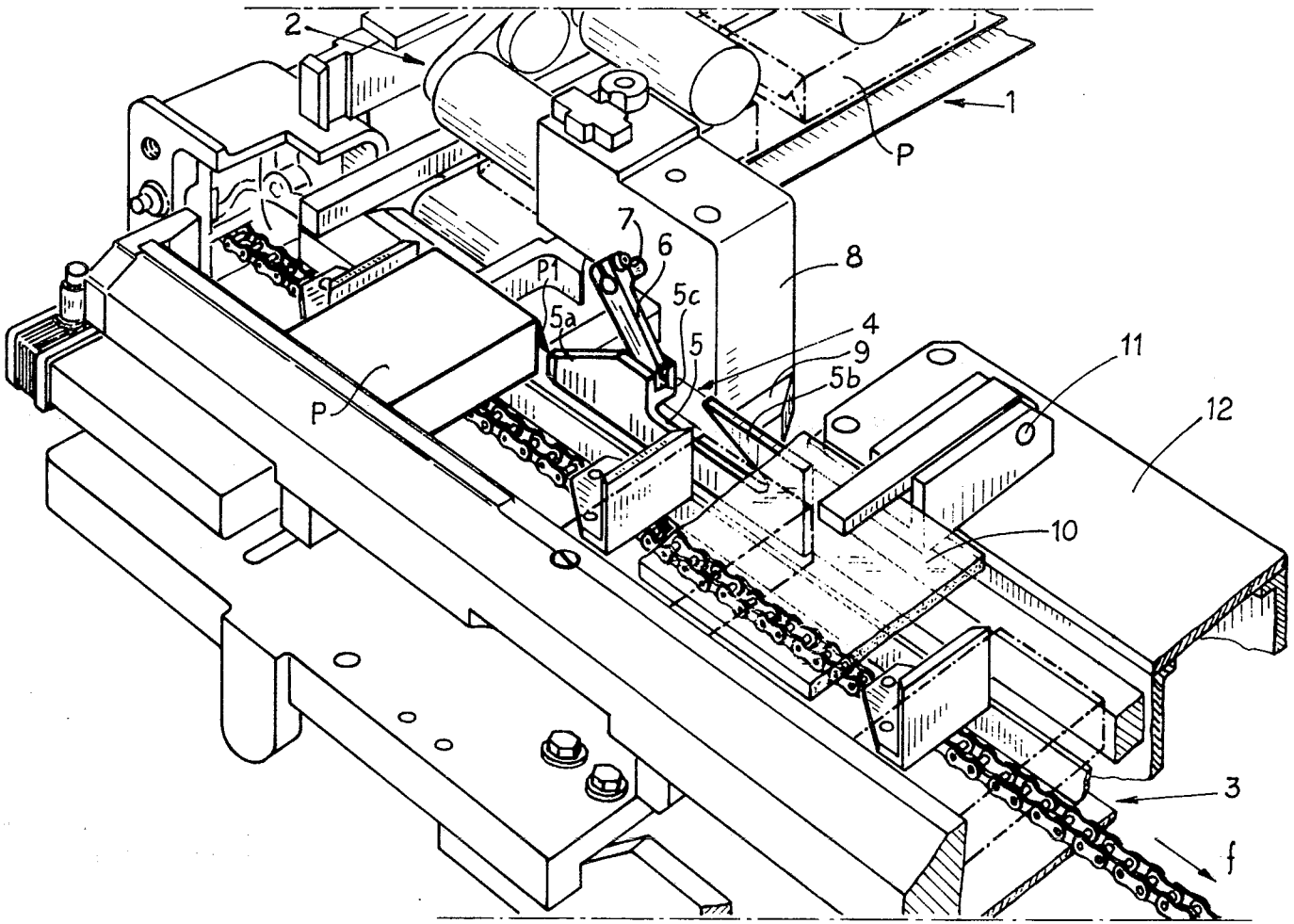
FIG. 1 shows diagrammatically, in a perspective view, the particular section of the link-up and conveyor means running between the two production machines, where the device forming the subject of the present invention is installed.

FIG. 1 shows the part of the conveyor means for the packets of cigarettes P positioned at an angle of 90° between the two production machines, that is to say, the wrapping or packeting machine and the overwrapping machine, which takes into consideration the requirements envisaged in commonly owned U.S. Ser. No. 432,587, filed Jan. 10, 1974.

Prior to the point where the change in direction occurs or, to be more precise, above the section of the conveyor globally numbered 1, a part of the non-return system, globally numbered 2 and forming the subject of the above mentioned patent application, can be seen, whilst on the section of the conveyor globally numbered 3, that is to say, on the part after the change in direction has been made, there is, globally numbered 4, the checking device forming the subject of the present invention.

The checking device 4 comprises a plate 5 which acts as a lateral wall for the conveyor branch 3 and is tangential to the base of the packets of cigarettes P.

The plate 5 has a terminal part 5*a* with a downward taper and a terminal part 5*b* with an upward taper, both tapers pointing in the direction opposite and parallel to that in which the conveyor branch 3 moves (arrow f).

Outside the tapered part 5*a* there is provided a U-shaped channel 5*c* inside which the free end of an arm 6 acts as a feeler means the other end of said arm 6 being fastened to a rotatable pin 7 which is used to trip a micro-switch 8 supported by a member 9.

The numeral 10 indicates a conventional movable cover for the conveyor branch 3, which cover is pivoted at 11 to a fixed part 12.

The checking device operates as explained hereinafter..

When a packet of cigarettes P branch carried on the conveyor 3 towards the overwrapping machine has its flap P1 not properly stuck onto the wrapping material constituting the or base of the packet of cigarettes P, during transferring comes into contact with the tapered part 5*a* of the plate 5 this part wedges itself underneath the flap P1, in between it and the wrapping material forming the base of the packet of cigarettes P1. The flap P′ is then lifted from the position shown in FIG. 1 to that shown in FIG. 2 and is inserted between the upper edge of the said plate 5 and the free end of the feeler device arm 6, thereby causing the latter to be raised.

As a result of the rotation of the pin 7 due to the angular rotatory displacement of the arm 6, the contact of the micro-switch 8 is closed and thus an electrical impulse is sent to the memory system or retard line.

Figure 3:
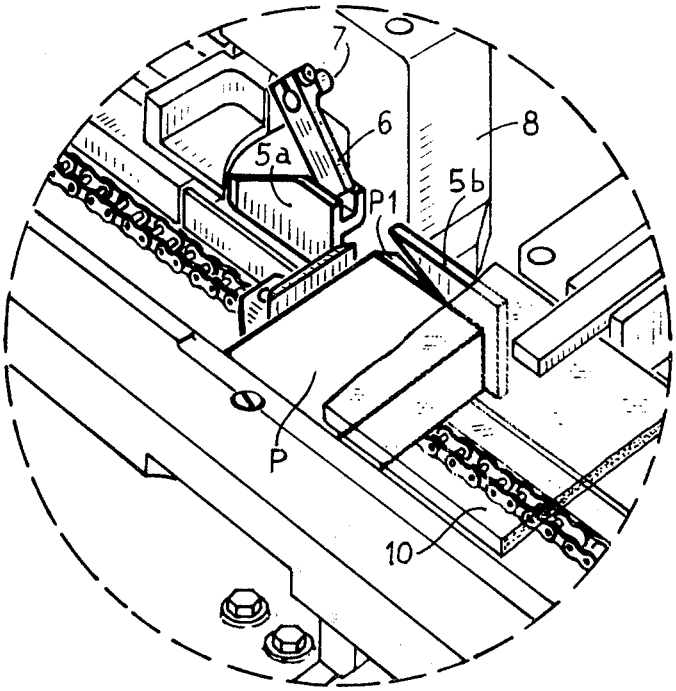

As the packet P continues moving along towards the overwrapping machine, the flap P1, previously lifted up by the tapered part 5*a* of the plate 5, meets the other tapered part 5*b* of the same plate 5 which restores it to the condition in which it was previously, that is to say, the condition shown in FIG. 3.

From this point onwards, the faulty packet P continues to pass normally through the overwrapping machine, just as a faultless packet would do, but once it arrives at the ejection/replenishment station of the overwrapping machine, it is expelled and replaced with a sound product kept in reserve. This, as will be seen from the brief description given hereunder of FIG. 4, is done in the usual conventional way.

Figure 4:
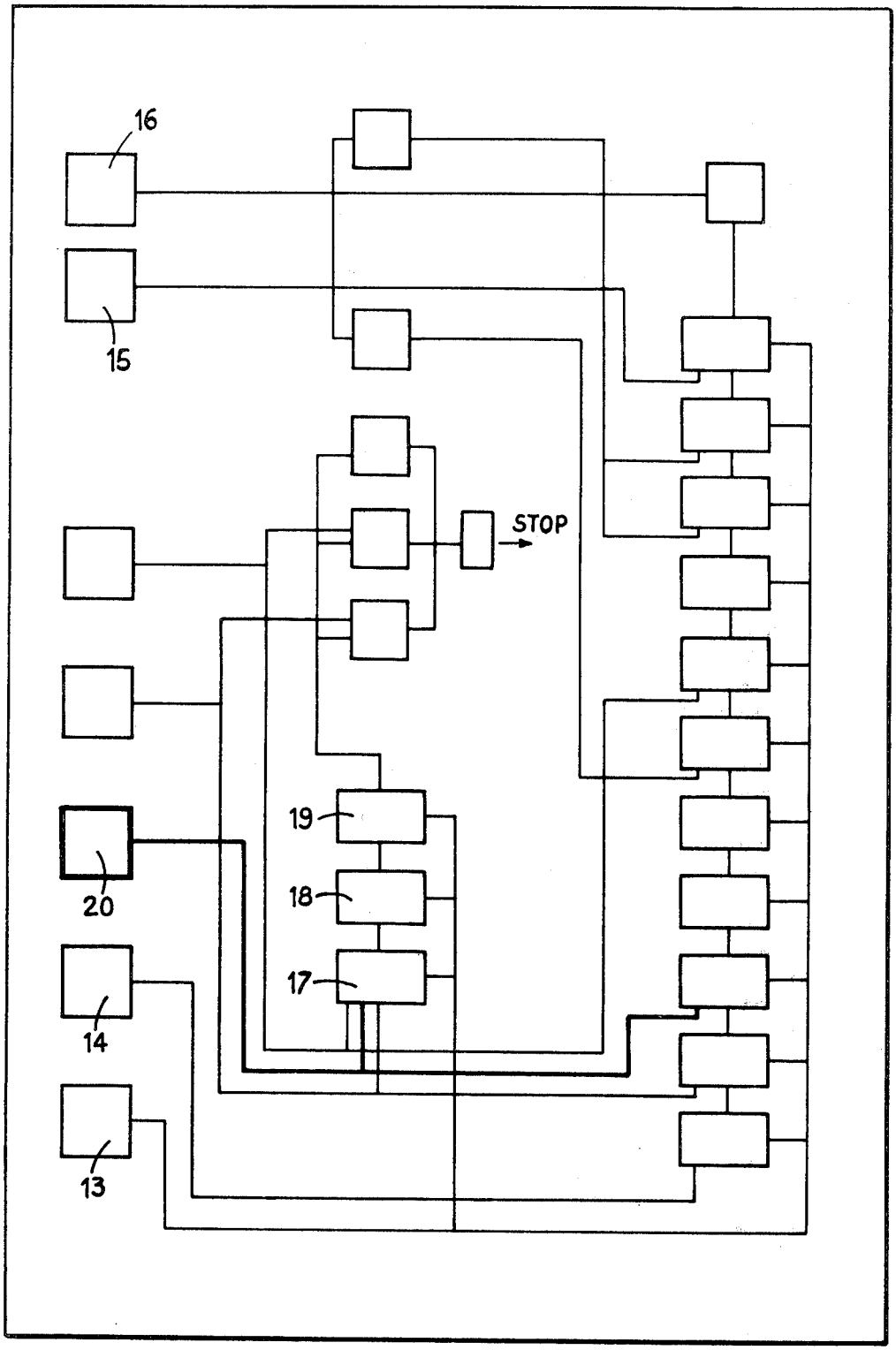
FIG. 4 shows, in block diagram form, the principle for operating the memory system or retard line of an overwrapping machine which works in conjunction with the device in question.

FIG. 4, as stated earlier on, provides a block diagram of a memory system or retard line operating on the principle envisaged in the previously mentioned U.S. Pat. No. 3,318,066 and used to check the operations carried out by the overwrapping machine to which it is fitted.

The said FIG. 4 shows, in fact, the functional structure of the memory to which are connected, for example, in addition to the normal synchronizer device or clock 13, the device 14 for checking that the overwrapping material on the finished reel is spliced to that on the new reel, the manual ejection control 15 and the ejection device 16 etcetera, also the electronic components 17, 18 and 19, as well as others too, for automatically stopping the overwrapping machine in the event of one of the abnormalities being checked, continuing.

Figure 2:
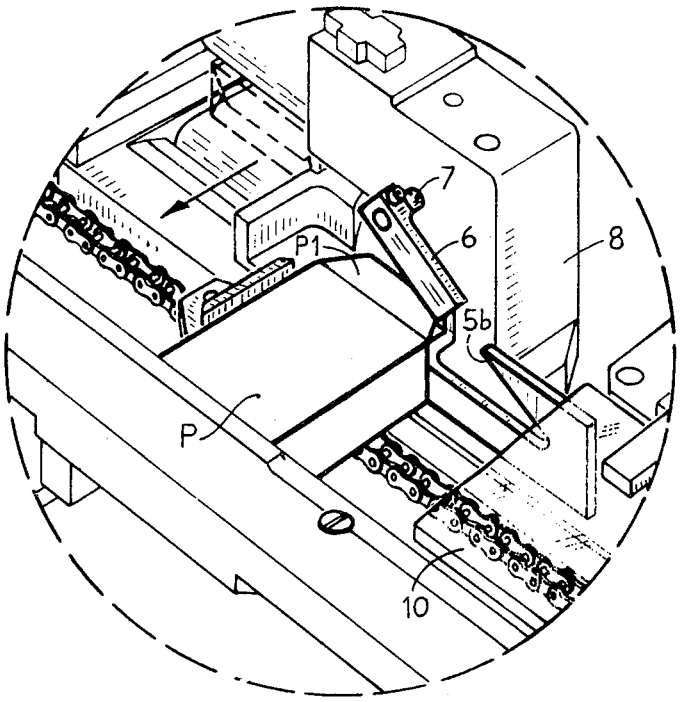
FIGS. 2 and 3 show diagrammatically, again in a perspective view, a detail of the device in question, seen from two different angles with respect to that in FIG. 1.

The checking device described herein with reference to FIGS. 1 to 3, which is also connected to the said memory system or retard line, sends the impulse caused by the closing of the contact of the micro-switch 8 to the component 20 and this, in turn, feeds it into both the step structure of the memory system, so that the faulty product in question will be ejected by the ejection device 16 at the one joint ejection/replenishment station on the production line of the overwrapping machine and to the electronic components 17, 18 and 19 which automatically stop the machine in the event of the detected fault continuing.

In this way, the predetermined object can be reached without adversely affecting the normal operation, at its rated speed, of the overwrapping machine.

What is claimed is:

1. A checking device for use in an apparatus for packaging cigarettes or similar material in a production line, said apparatus including at least one wrapping machine, at least one overwrapping machine linked by a conveyor to said wrapping machine, an ejection/replenishment means located downstream of said wrapping machine for ejecting packets from the production line and for replenishing the production line with reserve packets, at least one checking means for checking for the presence of faulty packets and emitting a signal when one is found, and a memory system for storing signals received from said checking means for activating said ejection/replenishment means after a delay sufficient to allow the faulty packet to reach said ejection/replenishment means, said checking device comprising:

lifting means for rendering a faulty base on a wrapped packet conspicuous;

feeler means adjacent to said lifting means for detecting the presence of a conspicuous base and for causing a signal to be emitted to the memory system to enable the ejection of the faulty packet and the replenishment of the production line with reserve products by the ejection/replenishment means; and restoring means adjacent to said feeler means for restoring said faulty base to the condition it was in prior to being made conspicuous by said lifting means and being detected by said feeler means.

2. A device according to claim 1, wherein said lifting means and restoring means comprise a plate placed along the conveyor tangent to the base of the packets, said lifting means having a terminal section with an upward taper and said restoring means having a terminal section with a downward taper with both of said tapers pointing in the opposite and parallel direction to that in which the conveyor moves.

3. A device according to claim 2, wherein said plate is in one single piece positioned in such a way as to constitute a lateral wall on the conveyor.

4. A device in accordance with claim 3 wherein said feeler means comprises an arm trippable by a faulty base lifted by said lifting means, said arm being positioned with respect to the upper edge of said plate such that the faulty base lifted by said lifting means is inserted between said upper edge and said arm, and a micro-switch means for emitting a signal to the memory system, said micro-switch being activated when said arm is tripped.

5. A device in accordance with claim 2 wherein said feeler means comprises an arm trippable by a faulty base lifted by said lifting means, said arm being positioned with respect to the upper edge of said plate such that the faulty base lifted by said lifting means is inserted between said upper edge and said arm, and a micro-switch means for emitting a signal to the memory system, said micro-switch being activated when said arm is tripped.

6. A device in accordance with claim 1 wherein said feeler means comprises an arm trippable by a faulty base lifted by said lifting means and a micro-switch means for emitting a signal to the memory system, said micro-switch being activated when said arm is tripped.

* * * * *

UNITED STATES PATENT AND TRADEMARK OFFICE

CERTIFICATE OF CORRECTION

PATENT NO. : 3,956,110

DATED : May 11, 1976

INVENTOR(S) : Enzo SERAGNOLI

It is certified that error appears in the above-identified patent and that said Letters Patent are hereby corrected as shown below:

[73] Assignee: G. D. Societa per Azioni, Bologna, Italy

Signed and Sealed this

Twenty-fourth Day of August 1976

[SEAL]

*Attest:*

RUTH C. MASON
*Attesting Officer*

C. MARSHALL DANN
*Commissioner of Patents and Trademarks*